US006702412B2

(12) United States Patent
Dobler et al.

(10) Patent No.: US 6,702,412 B2
(45) Date of Patent: Mar. 9, 2004

(54) EXPANDABLE SLIDE AND RAIL ASSEMBLY FOR A RACK AND METHOD OF INSTALLING SAME

(75) Inventors: Karl J. Dobler, Cypress, TX (US); Kelly K. Smith, Spring, TX (US); Robert J. Hastings, Kingwood, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/955,720

(22) Filed: Sep. 19, 2001

(65) Prior Publication Data

US 2003/0052581 A1 Mar. 20, 2003

(51) Int. Cl.[7] ..... A47B 88/04
(52) U.S. Cl. ..... 312/334.5; 312/205
(58) Field of Search ..... 312/205, 334.5, 312/334.8, 334.4, 348.1, 334.1, 330.1, 333

(56) References Cited

U.S. PATENT DOCUMENTS 3,092,429 A * 6/1963 Barnes ..... 312/333
5,833,337 A * 11/1998 Kofstad ..... 312/334.5
6,224,177 B1 5/2001 Chu
6,231,138 B1 5/2001 Janson
6,257,683 B1 7/2001 Yang

* cited by examiner

*Primary Examiner*—Lanna Mai
*Assistant Examiner*—Jerry A. Anderson

(57) ABSTRACT

A track assembly, adapted to be mounted in a housing, having first and second rail members aligned with one another and allowed limited relative longitudinal movement with respect to the other. The joined first and second rail members have a mounting bracket attached to distal ends of the rail members. A spring, positioned between the rail members, provides a force extending the distance between the distal ends of the rail members. A locking mechanism interacts with the rail members and has a locked position resisting inward movement of the distal ends. The method of installing the track assembly in a rack is accomplished by compressing the track assembly to reduce its overall length prior to positioning it between opposing rack members. The track assembly is released to securely engage the opposing rack members and locked in position.

9 Claims, 6 Drawing Sheets

EXPANDABLE SLIDE AND RAIL ASSEMBLY FOR A RACK AND METHOD OF INSTALLING SAME

CROSS-REFERENCE TO RELATED APPLICATIONS

Not applicable.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates to a slide and rail assembly and method for installation in a rack, more particularly, to a slide and rail assembly and method for use in mounting a server in a rack.

2. Description of the Related Art

There are numerous incidences where a slide and rail assembly is used. For example, a slide and rail assembly is used pull out drawers or shelves. Typically, the rail is mounted in a case, rack or other framed assembly and the slide is attached to the drawer, shelf or other device. The slide cooperates with the rail and provides the extension mechanism for the drawer or shelf.

Typically, the mounting and installation of the slide and rail assembly involves mechanical fasteners requiring hand tools. This requires time and organization and is cumbersome. Additionally, there are many instances in which it may be desirable to make vertical adjustments in the arrangement of the drawers, shelves, etc. supported by the slide and rail assembly. For example, there are racks used to house servers for computer networks. The variation in the number, size and arrangement of the servers to be installed in the rack requires versatility in placement of the slide and rail assemblies. Furthermore, it is desirable to be able to install or adjust the assemblies with ease and with a minimum of mounting hardware and tools. A system is needed that will accommodate a variety of servers in a rack, both in size and quantity.

There is a need for a slide and rail assembly for installation in a rack that does not require the use of tools or fasteners. Additionally, it is desirable that the slide and rail assembly be simple to install and requires little time for the installation. Further, it is desirable that the slide and rail assembly be easy to remove, if desired.

SUMMARY OF THE INVENTION

The present invention is a slide and rail assembly and method of installation in a rack that does not require the use of tools or fasteners. The invention includes a track assembly, adapted to be mounted in a rack or housing, having first and second rail members aligned and joined with one another and allowed limited relative longitudinal movement with respect to each other. The joined first and second rail members have a mounting bracket attached to distal ends of the rail members. The mounting brackets have a tab or tabs for insertion in slots in the rack. A spring, positioned between the rail members, provides a force extending the distance between the distal ends of the rail members.

The present invention includes a locking mechanism interacting with the rail members. The locking mechanism has a locked position resisting inward movement of the distal ends of the rail members. The locking mechanism includes a catch attached to one of the rail members and a trigger mounted to the other rail member. In the locked position, the relative inward movement of the rail members is limited by the trigger engaging the catch.

The method of installing the track assembly to the rack or housing is very simple and requires very little time. Additionally, the track assembly can also be very easily and quickly removed from the rack or housing, if desired. To install the track assembly to the rack, the mounting tab or tabs at one end of the rail assembly, for example the first rail member tabs, are inserted into the slots of the rack. The locking mechanism trigger is depressed and the rail assembly and spring is compressed longitudinally. The second rail member tabs are then aligned and inserted into the appropriate slots in the rack. As the spring expands forcing the second rail to extend with the member tabs in the appropriate slots, the catch moves relative to the trigger to a point where the spring-biased trigger engages the catch. When the rail assembly is installed in the rack, the trigger captures the catch such that they are contacting or in close proximity, thus preventing disengagement of the tabs from the rack slots unless the trigger is depressed to unlock the locking mechanism and allow inward relative movement of the support rail members.

BRIEF DESCRIPTION OF THE DRAWINGS

The objects, advantages and features of the invention will become more apparent by reference to the drawings which are appended hereto and wherein like numerals indicate like parts and wherein illustrated embodiments of the invention are shown, in which.

DETAILED DESCRIPTION OF INVENTION

Figure 10:
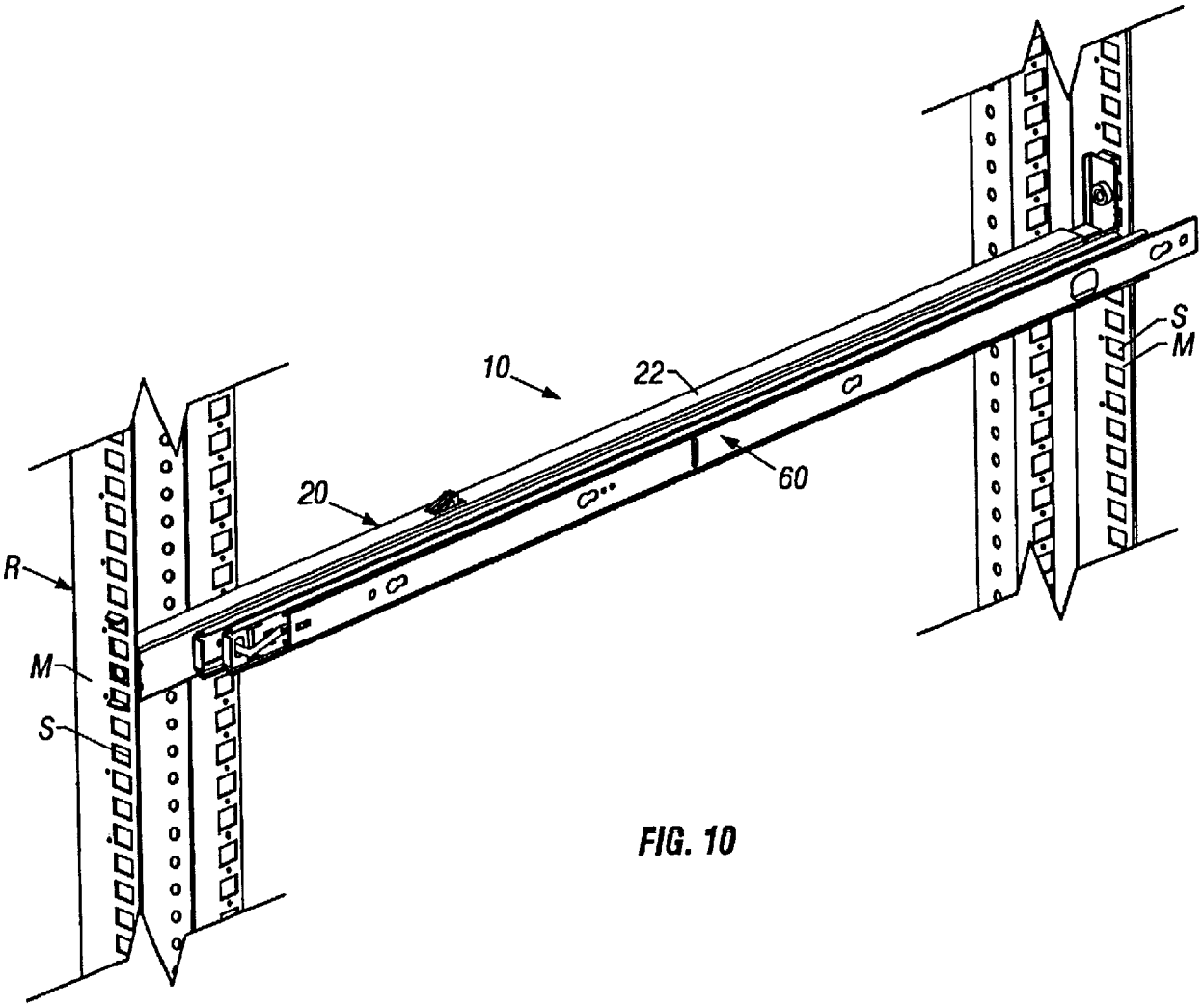
FIG. 10 is a perspective view of the sliding track assembly installed in a rack.

The present invention will now be described in greater detail with specific reference to the drawings. In the preferred embodiment of the present invention, the track assembly, generally designated as 10, includes a rail assembly 20 and a slide assembly 60 as shown in FIG. 10. The rail and slide assemblies, 20 and 60 respectively, are preferably adapted to quickly and easily attach securely together without the use of tools or other fasteners. However, it is to be understood that the present invention is not limited to the preferred embodiment as shown and described with respect to the attachment of the slide assembly 60 to the rail assembly 20. In fact, the present invention is directed primarily to the features of the rail assembly 20 and the method of installation of the rail assembly 20 to a rack R. Thus, the track assembly 10 of the present invention does not even require the inclusion of a detachable slide assembly or a slide assembly mounted to the rail assembly 20. For the sake of completeness in describing the use of the track assembly 10 to mount a device, such as a server, in a rack, the slide assembly 60 is shown and described.

In the preferred embodiment of the present invention, the rail assembly 20 includes a support rail 22 adapted to span between opposing members M of a rack, stand or other device as shown in FIG. 10. In some instances it may be desirable to be able to adjust the elevation of the rail assemblies 20 in the rack R or other device or simply allow installation without the use of tools. Thus, the preferred embodiment of the rail assembly 20, shown in FIGS. 1–3, 9 and 10, is easy and quick to install and requires no tools for installation in the rack or removal from the rack R. It is to be understood that certain of the described features are not required for the track assembly 10 of the present invention but may be desirable.

Figures 1, 4:
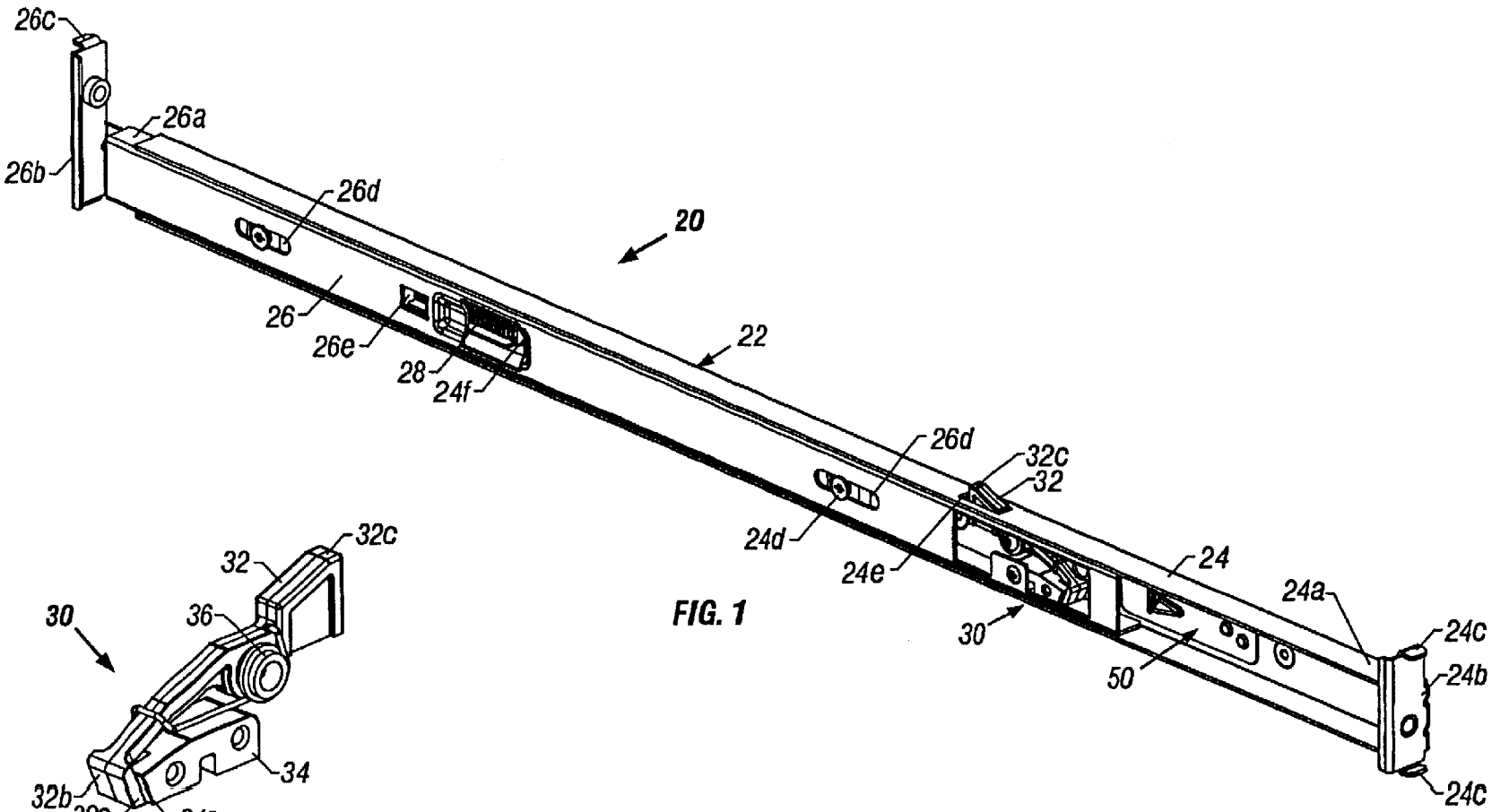
FIG. 1 is a perspective view of a rail assembly according to a preferred embodiment of the present invention.
FIG. 4 is a perspective view of a locking mechanism of the rail assembly of FIG. 1.
Figure 2:
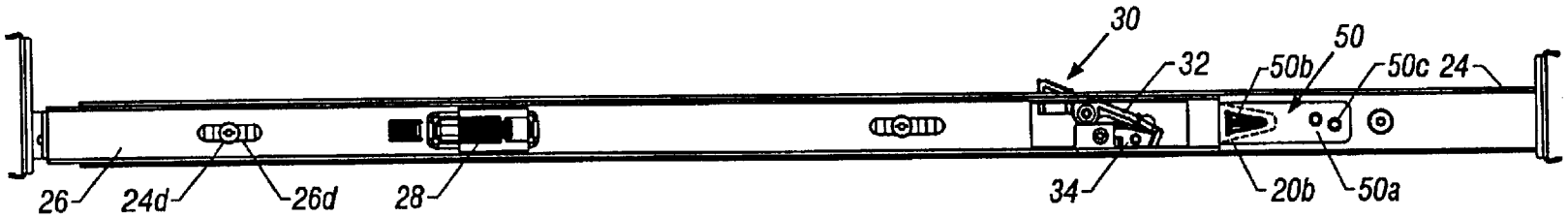
FIG. 2 is a side elevation view of the rail assembly of FIG. 1.

Referring to FIGS. 1 and 2, the support rail 22 of the preferred embodiment comprises cooperating first and second rail members, 24 and 26 respectively. The support rail members 24 and 26 are generally C-shaped in cross-section with the second rail member 26 slightly smaller in height and width than the first rail member 24 so as to allow the second rail member 26 to slide within the first rail member 24.

As shown in FIG. 1, the distal ends 24*a* and 26*a* of the rail members 24 and 26, respectively, include mounting brackets 24*b* and 26*b*. Each mounting bracket 24*b*, 26*b* includes one or more mounting tabs 24*c*, 26*c*, respectively. The mounting tabs 24*c*, 26*c* are adapted to be received in mounting slots S in the rack R (FIG. 10), stand, or other device in which the track assembly 10 is being installed.

Referring to FIGS. 1 and 2, the rail assembly 20 has a limited overall length adjustment. In an uninstalled condition, the rail assembly 20 is preferably slightly longer than the distance between opposing rack members M, whereas during installation the rail assembly 20 is preferably shorter than the distance of the opposing rack members M. In the preferred embodiment, the first and second rail members 24 and 26 are allowed limited longitudinal movement relative to each other. As shown in FIGS. 1 and 2, the second rail member 26 is shown as having one or more longitudinal elongated slots 26*d*. A fastener 24*d*, such as a screw, having a head larger than the slot height is inserted through the elongated slot 26*d* and fastened to the first rail member 24, preferably via a threaded connection. The fasteners 24*d* secure the rail members 24 and 26 to each other and allow sliding longitudinal movement limited to the length of the elongated slot 26*d*.

Referring to FIG. 1, the rail assembly 20 includes a spring 28, preferably a compression spring, positioned between opposing folded tabs 24*f* and 26*e* of the first and second rail members 24 and 26, respectively, to provide a spring-biased force to extend the rail members 24 and 26 in an outwardly direction along their length. The spring 28 is compressed during the installation of the mounting tabs 24*c*, 26*c* in the rack slots S and thus serves to exert an outward force against each of the rail members 24, 26 to maintain the mounting tabs 24*c*, 26*c* in their respective slots S.

Figure 5:
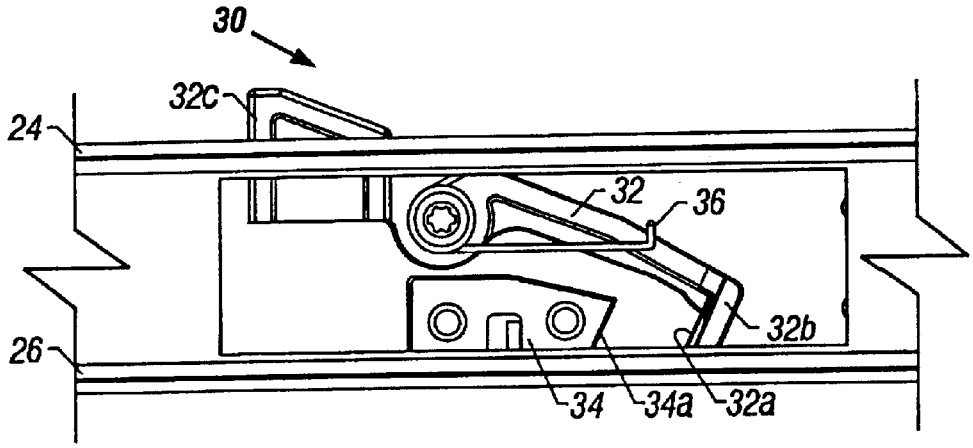
FIG. 5 is an enlarged elevation view of the locking mechanism prior to installation of the rail assembly in a rack.
Figure 6:
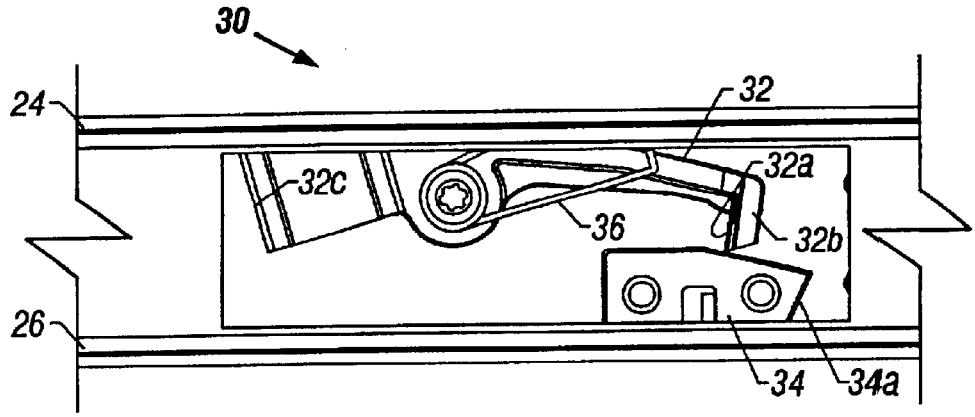
FIG. 6 is an enlarged elevation view of the locking mechanism during the installation of the rail assembly in the rack.
Figure 7:
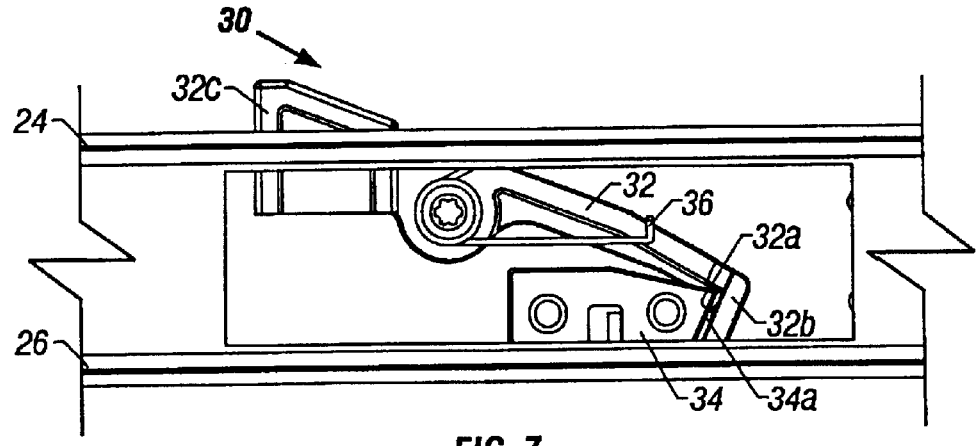
FIG. 7 is an enlarged elevation view of the locking mechanism after installation of the rail assembly in the rack.

Referring to FIGS. 1–7, the preferred embodiment of the rail assembly 20 may include a locking mechanism 30 comprised of a trigger 32, a catch 34 and a spring 36. FIG. 4 shows an enlarged view of the locking mechanism 30. Referring to FIGS. 5–7, the catch 34 is securely mounted to the inside portion of the second rail member 26 and the trigger 32 is pin or pivotally connected to the first rail member 24. The catch 34 includes an angled face 34*a* adapted to engage a correspondingly angled trigger face 32*a* at the front 32*b* of the trigger 32 when the rail assembly 20 is installed as explained below. The trigger 32 has a rear 32*c* which extends through a window 24*e* (FIG. 1) in the first rail member 24. The trigger spring 36 exerts a spring force to cause the front 32*b* of the trigger 32 to rotate towards the catch 34 and the rear 32*c* of the trigger 32 to extend through the window 24*e*.

Installation of the rail assembly 20 described above will now be explained in detail. The rail assembly 20 and the locking mechanism 30 is initially in the position as shown in FIG. 5. In the initial position of the rail assembly 20, the compression spring 28 forces the first and second rail members 24 and 26 to the extended position and the catch 34 is not engaged by the trigger 32 as shown in FIG. 5. The mounting tab or tabs at one end of the rail assembly 20, for example the first rail member tabs 24*c*, are inserted into the slots S (FIG. 10) of the rack R. Referring next to FIG. 6, the trigger rear 32*c* is depressed and the rail assembly 20 is compressed longitudinally compressing the spring 28 and allowing the catch face 34*a* to pass below the raised trigger front 32*b*. The second rail member tabs 26*c* are then aligned and inserted into the appropriate slots S in the rack R as shown in FIG. 10. As the spring 28 expands forcing the second rail to extend with the member tabs 26*c* in the appropriate slots S, the catch 34 moves relative to the trigger 32 to a point where the catch 34 travels beyond the trigger face 32*a*, thus permitting the face 32*a* of the spring-biased trigger 32 to engage the catch face 34*a* as shown in FIGS. 1, 2 and 7. It is important to understand that when the rail assembly 20 is installed in the rack R, the trigger 32 captures the catch 34 and the faces 32*a* and 34*a* are contacting or in close proximity such that none of the tabs 24*c* and 26*c* can be disengaged from the rack slots S unless the trigger rear 32*c* is depressed to allow inward relative movement of the support rail members 22 and 24.

Figure 3:
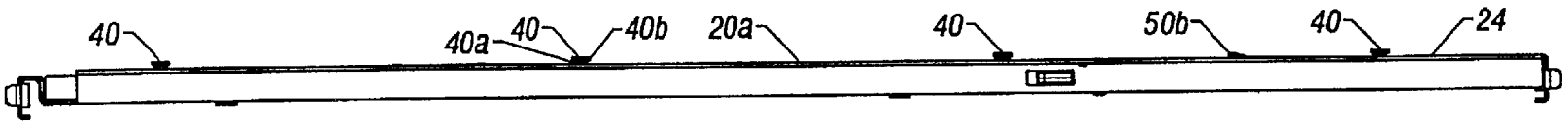
FIG. 3 is a top plan view of the rail assembly of FIG. 1.
Figure 9:
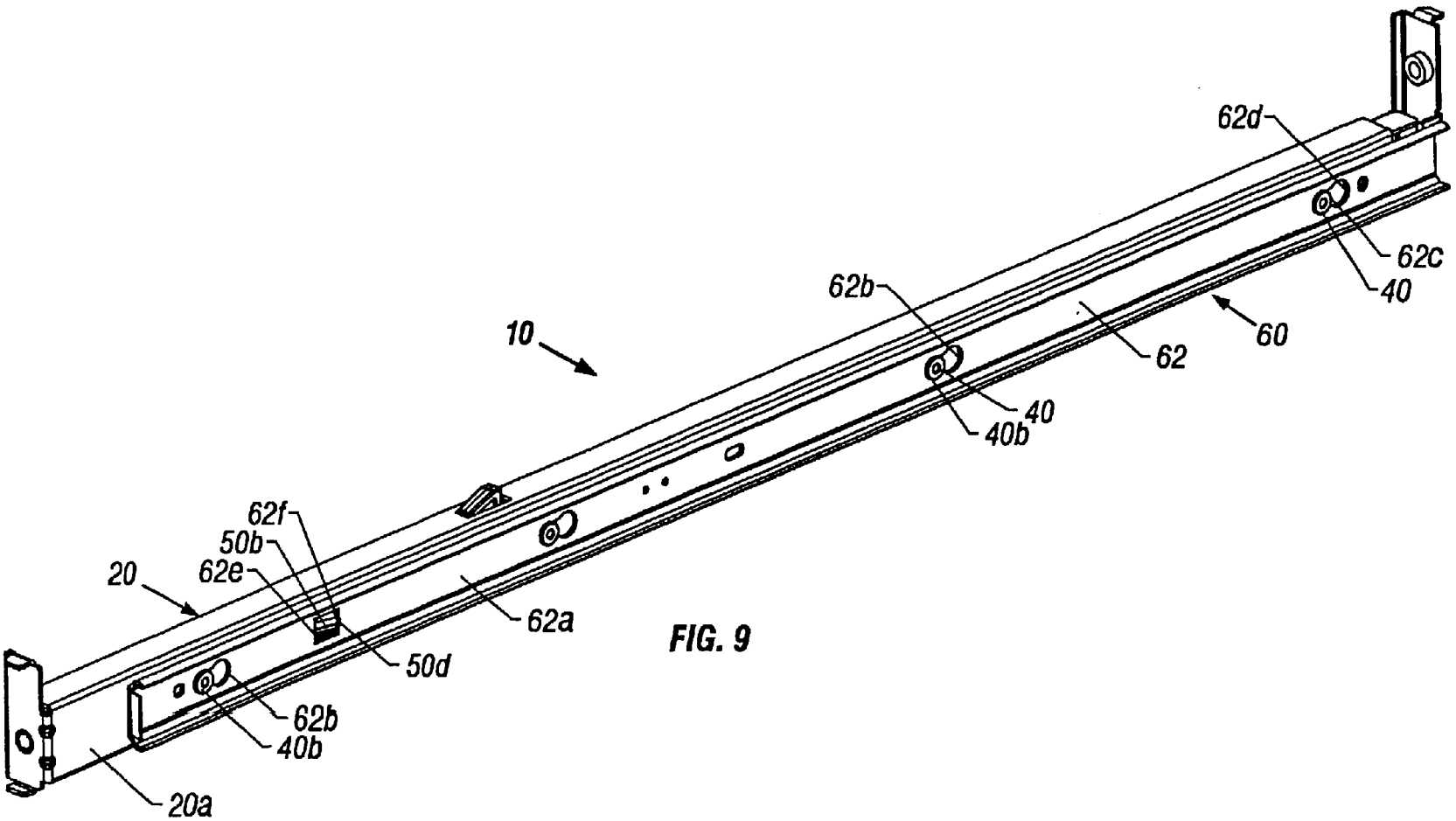
FIG. 9 is a perspective view of the sliding track assembly in the assembled condition with a portion of the slide assembly removed for clarity.

Referring to FIGS. 3 and 9, the rail assembly 20 may include one or more shoulder standoffs 40 extending beyond a face 20*a* of the rail assembly 20. The shoulder standoff 40 includes a short shaft 40*a* (FIG. 3), preferably cylindrical, and a head 40*b*. Preferably, the head 40*b* is circular and has a diameter greater than the diameter of the short shaft 40*a*. The short shaft 40*a* extends generally perpendicularly from the rail assembly face 20*a* and the head 40*b* preferably includes a lower flat face 40*c* that is generally parallel with the rail assembly face 20*a*.

Figure 8:
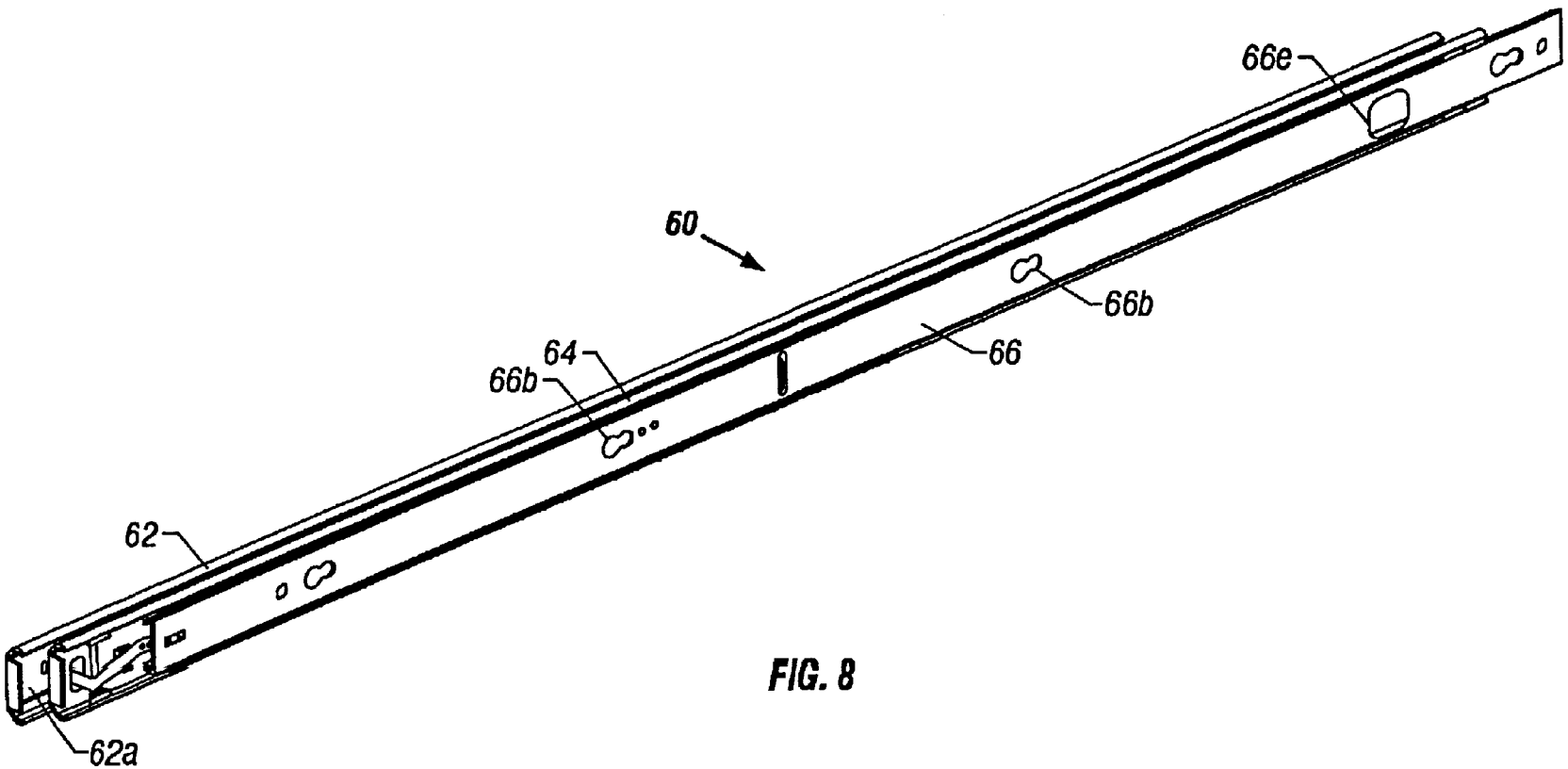
FIG. 8 is a perspective view of a slide assembly according to a preferred embodiment of the present invention.

With reference to FIGS. 8 and 9, the slide assembly 60 may include a slide member 62 having a generally flat surface 62*a* with a keyhole-shaped opening 62*b* for each shoulder standoff 40. It is to be understood that in FIG. 9 a portion of the slide assembly 60 has been removed for purposes of clarity. The opening 62*b* includes a slotted portion 62*c* which expands to an enlarged circular portion 62*d*. The slotted portion 62*c* has a height slightly greater than the short shaft 40*a* and the circular portion 62*d* is slightly greater than the diameter of the head 40*b* of the shoulder standoff 40. Thus, to mount the slide assembly 60 to the rail assembly 20 the heads 40*b* of the shoulder standoffs 40 are inserted through the enlarged circular portions 62*d* of the slide member 62 and the slide member 62 slid such that the short shafts 40*a* are received in the slotted portion 62*c* and retained therein by the head 40*b* lower face contacting the slide member 62.

Referring to FIGS. 1 and 2, the rail assembly 20 may include a latch mechanism 50 mounted to the rail assembly 20. The latch mechanism 50 includes a spring plate 50*a* having a raised portion 50*b* which is allowed to extend through a window 20*b* in the rail assembly 20. Preferably, the spring plate 50*a* is mounted to the rail assembly 20 near a first end 50*c* of the spring plate 50*a*. Referring to FIG. 9, the slide member 62 includes a latch opening 62*e* having an edge portion 62*f* adapted to engage a spring latch edge 50*d* of the raised portion 50*b* to lock the slide assembly 60 to the rail assembly 20. As shown in FIG. 9, the spring latch edge 50*d* springs through the latch opening 62*e* adjacent the opening edge portion 62*f* upon the shoulder standoffs 40 becoming seated in the slotted portions 62*c* of the keyhole-shaped openings 62*b*.

As described above, the method of assembling the slide assembly 60 to the rail assembly 20 is very simple and requires very little time. Furthermore, the slide assembly 60 can also be very easily and quickly removed from the rail assembly 20, if desired. To install the slide assembly 60 to the rail assembly 20, the keyhole-shaped openings 62*b* of the slide member 62 are positioned onto the shoulder standoffs 40. The raised portion 50*b* of the spring latch mechanism 50 extending through window 20*b* is depressed by the slide member 62 contacting the rail assembly 20. The slide member 62 is slid along the rail assembly 20 with the shoulder standoffs 40 within the keyhole-shaped openings 62*b* until the spring latch edge 50*d* of the raised portion 50*b* reaches the latch opening 62*e* and springs into the latch opening 62*e*. Once in position, the attached slide assembly 60 cannot be removed unless the raised portion 50*b* of the spring latch mechanism 50 is depressed below the latch opening 62*e* and the slide member 60 slid off of the shoulder standoffs 40.

It is to be understood that the track assembly 10 has been described as a single assembly. However, it is to be understood that the track assembly 10 typically includes a left track assembly and right track assembly. Thus, a pair of track assemblies 10 will typically be used together to support a drawer, shelf, tray or other type of housing.

Furthermore, it is to be understood that the track assembly 10 of the present invention may or may not include the slide assembly 60 as shown and described. While the intended usage of the present invention typically includes a slide assembly 60, a different type of slide assembly may be used in conjunction with the track assembly 10. It is also to be understood that the slide assembly need not mount or be removed in the manner described above.

The foregoing disclosure and description of the invention is illustrative and explanatory thereof, and various changes in the size, shape, and materials, as well as in the details of illustrative construction and assembly, may be made without departing from the spirit of the invention.

We claim:

1. In a sliding track assembly adapted to be mounted in a rack, the sliding track assembly having a slide assembly mounted to a rail assembly, the improvement comprising the rail assembly having:

first and second rail members joined longitudinally with relative longitudinal movement there between, each of said first and second rail members having a mounting bracket attached to a distal end of said rail member; and a locking mechanism interacting with said first and second rail members, said locking mechanism having a locked position limiting inward movement of said rail members.

wherein said locking mechanism comprises:

a catch attacked to one of said rail members;

a trigger mounted to the other said rail member, wherein in said locked position the relative inward movement of said rail members is limited by said trigger engaging said catch.

2. The sliding track assembly of claim 1, wherein said trigger is biased in said locked position.

3. The sliding track assembly of claim 1, wherein said locking mechanism further comprises a spring to bias said trigger in said locked position.

4. The sliding track assembly of claim 1, wherein said trigger includes a rear portion extending beyond said first and second rail members in said locked position, wherein said rear portion is adapted to be manually manipulated to unlock said locking mechanism.

5. A track assembly adapted to be mounted in a housing, the track assembly comprising:

a first rail member;

a second rail member joined and aligned with said first rail member and allowed limited relative longitudinal movement with respect to said first rail member;

said joined first and second rail members having a mounting bracket attached to distal ends of said joined rail members;

a spring positioned between said joined first and second rail members providing a force extending the distance between said distal ends of said joined rail members; and a locking mechanism interacting with said first and second rail members, said locking mechanism having locked position resisting inward movement of said distal ends of said jointed rail members, wherein said first and second rail members slidably engage each other, further wherein said first and second rail members are C-shaped in cross-section with said second rail member having a height slightly less than the height of said first rail member.

6. A track assembly adapted to be mounted in a housing, the track assembly comprising:

a first rail member;

a second rail member joined and aligned with said first rail member and allowed limited relative longitudinal movement with respect to said first rail member;

said joined first and second rail members having a mounting bracket attached to distal ends of said joined rail members;

a spring positioned between said joined first and second rail members providing a force extending the distance between said distal ends of said joined rail members; and a locking mechanism interacting with said first and second rail members, said locking mechanism having locked position resisting inward movement of said distal ends of said jointed rail members, wherein said locking mechanism comprises:

a catch attached to said second rail member; and a trigger mounted to said first rail member, wherein in said locked position said trigger limits inward movement of said second rail member.

7. The track assembly of claim 6, wherein said trigger is biased in said locked position.

8. The track assembly of claim 7, wherein said locking mechanism further comprises a spring to bias said trigger in said locked position.

9. The track assembly of claim 6, wherein said trigger includes a rear portion extending beyond said first and second rail members in said locked position, wherein said rear portion is adapted to be manually manipulated to unlock said locking mechanism.

* * * * *